US012790912B1

(12) United States Patent
Shkurti et al.

(10) Patent No.: US 12,790,912 B1
(45) **Date of Patent: *Nov. 10, 2026**

(54) FRAC PLUG AND METHOD OF CONTROLLING FLUID FLOW IN PLUG AND PERFORATION SYSTEMS

(71) Applicant: Longbow Completion Services, LLC, Midland, TX (US)

(72) Inventors: Piro Shkurti, The Woodlands, TX (US); Christopher Crews, Splendora, TX (US); Shawn Witt, Keller, TX (US)

(73) Assignee: Longbow Completion Services, LLC, Midland, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/581,293

(22) Filed: Feb. 19, 2024

Related U.S. Application Data

(63) Continuation of application No. 17/501,494, filed on Oct. 14, 2021, now Pat. No. 11,933,132.

(60) Provisional application No. 63/091,636, filed on Oct. 14, 2020.

(51) Int. Cl.

| | |
|---|---|
| ***E21B 33/12*** | (2006.01) |
| ***E21B 33/134*** | (2006.01) |
| ***E21B 34/14*** | (2006.01) |
| ***E21B 43/26*** | (2006.01) |

(52) U.S. Cl.
CPC ..... *E21B 33/1208* (2013.01); *E21B 33/134* (2013.01); *E21B 34/142* (2020.05); *E21B 43/261* (2013.01); *E21B 2200/04* (2020.05)

(58) Field of Classification Search
CPC ..... E21B 33/1208; E21B 43/261; E21B 2200/04; E21B 33/134
See application file for complete search history.

(56) References Cited

U.S. PATENT DOCUMENTS

| | | | | |
|---|---|---|---|---|
| 2,549,007 | A * | 4/1951 | Ragan | E21B 33/12 137/71 |
| 2,665,765 | A | 1/1954 | Baker | |
| 2,671,510 | A | 3/1954 | Slick et al. | |
| 2,829,719 | A | 4/1958 | Clark | |
| 3,602,934 | A | 9/1971 | Reed | |
| 6,167,963 | B1 | 1/2001 | McMahan et al. | |
| 6,213,204 | B1 | 4/2001 | Doane | |
| 6,220,360 | B1 | 4/2001 | Connell et al. | |
| 6,244,642 | B1 | 6/2001 | Serafin et al. | |
| 6,491,116 | B2 | 12/2002 | Berscheidt et al. | |

(Continued)

FOREIGN PATENT DOCUMENTS

| | | |
|---|---|---|
| CN | 216553870 U | 5/2022 |
| GB | 2448960 A | 11/2008 |

*Primary Examiner* — Tara Schimpf
*Assistant Examiner* — Daniel T Craig
(74) *Attorney, Agent, or Firm* — Crowe & Dunlevy, P.C.

(57) ABSTRACT

A ball-in-place plug configured to isolate formation zones within a wellbore includes an anchoring subassembly configured to secure the ball-in-place plug in the wellbore and a flow control subassembly configured to control the flow of fluid through the plug. The flow control subassembly is configured to allow bidirectional flow of fluid through the ball-in-place plug before the ball-in-place plug is activated, and wherein the flow control subassembly is configured to permit only unidirectional flow of fluid through the ball-in-place plug after the ball-in-place plug is activated.

18 Claims, 11 Drawing Sheets

(56) References Cited

U.S. PATENT DOCUMENTS

| | | | | |
|---|---|---|---|---|
| 7,100,700 | B2 | 9/2006 | Davis et al. | |
| 7,475,736 | B2 | 1/2009 | Lehr et al. | |
| 7,810,558 | B2 | 10/2010 | Shkurti et al. | |
| 8,047,280 | B2 | 11/2011 | Tran et al. | |
| 8,469,088 | B2 | 6/2013 | Shkurti et al. | |
| 9,045,963 | B2 | 6/2015 | Shkurti et al. | |
| 9,157,288 | B2 | 10/2015 | Martinez | |
| 9,404,330 | B2 | 8/2016 | Speer et al. | |
| 9,835,003 | B2 | 12/2017 | Harris et al. | |
| 10,024,125 | B2 | 7/2018 | Webster et al. | |
| 10,024,134 | B2 | 7/2018 | Webster et al. | |
| 10,100,601 | B2 | 10/2018 | King et al. | |
| 10,415,345 | B2 | 9/2019 | Yue et al. | |
| 10,435,982 | B2 | 10/2019 | Shkurti et al. | |
| 10,822,902 | B2 | 11/2020 | Davis et al. | |
| 11,131,163 | B2 | 9/2021 | Lee et al. | |
| 11,891,877 | B1 | 2/2024 | Crews et al. | |
| 11,933,132 | B1 * | 3/2024 | Shkurti | E21B 33/134 |
| 2003/0111236 | A1 | 6/2003 | Serafin et al. | |
| 2003/0226660 | A1 | 12/2003 | Winslow et al. | |
| 2004/0251025 | A1 | 12/2004 | Giroux et al. | |
| 2008/0073074 | A1 | 3/2008 | Frazier | |
| 2008/0199339 | A1 | 8/2008 | Near | |
| 2011/0240295 | A1 | 10/2011 | Porter et al. | |
| 2011/0259610 | A1 | 10/2011 | Shkurti et al. | |
| 2011/0315403 | A1 | 12/2011 | Nard et al. | |
| 2012/0125637 | A1 | 5/2012 | Chenault et al. | |
| 2012/0181032 | A1 | 7/2012 | Naedler et al. | |
| 2012/0255723 | A1 | 10/2012 | Standridge | |
| 2014/0027127 | A1 | 1/2014 | Frazier et al. | |
| 2014/0060812 | A1 | 3/2014 | Young et al. | |
| 2014/0190685 | A1 | 7/2014 | Frazier et al. | |
| 2015/0275605 | A1 | 10/2015 | Bennett et al. | |
| 2015/0285026 | A1 | 10/2015 | Frazier | |
| 2015/0330185 | A1 * | 11/2015 | Hughes | E21B 34/103 166/318 |
| 2015/0345256 | A1 | 12/2015 | Tulloch | |
| 2016/0032684 | A1 | 2/2016 | Shkurti et al. | |
| 2016/0084040 | A1 * | 3/2016 | Brasseaux | E21B 34/10 166/194 |
| 2016/0222760 | A1 | 8/2016 | Stair et al. | |
| 2017/0101845 | A1 | 4/2017 | Kellner et al. | |
| 2018/0106120 | A1 | 4/2018 | Harris et al. | |
| 2018/0187509 | A1 | 7/2018 | Zhong et al. | |
| 2018/0320478 | A1 | 11/2018 | Themig et al. | |
| 2019/0316434 | A1 | 10/2019 | Davies et al. | |
| 2020/0048981 | A1 | 2/2020 | Coon et al. | |
| 2020/0072008 | A1 | 3/2020 | Dirocco | |
| 2020/0115988 | A1 | 4/2020 | Wilcox et al. | |
| 2020/0141207 | A1 | 5/2020 | Smith et al. | |
| 2020/0157900 | A1 | 5/2020 | Hern et al. | |
| 2020/0157913 | A1 | 5/2020 | Hern et al. | |
| 2020/0181995 | A1 | 6/2020 | Blakey et al. | |
| 2020/0347694 | A1 | 11/2020 | Power et al. | |
| 2021/0317724 | A1 | 10/2021 | Romer et al. | |
| 2022/0034191 | A1 | 2/2022 | Barrett et al. | |
| 2023/0243231 | A1 | 8/2023 | Zakharia et al. | |

* cited by examiner

FRAC PLUG AND METHOD OF CONTROLLING FLUID FLOW IN PLUG AND PERFORATION SYSTEMS

RELATED APPLICATIONS

This application is a continuation of U.S. patent application Ser. No. 17/501,494 filed Oct. 14, 2021 entitled, "Frac Plug and Method of Controlling Fluid Flow in Plug and Perforation Systems," which claims the benefit of U.S. Provisional Patent Application Ser. No. 63/091,636 filed Oct. 14, 2020 entitled, "Frac Plug and Method of Controlling Fluid Flow in Plug and Perforation Systems," the disclosures of which are herein incorporated by reference.

FIELD OF THE INVENTION

This invention relates generally to the field of hydraulic fracturing systems, and more particularly, but not by way of limitation, to a plug for controlling access to selective zones within a well during a hydraulic fracturing operation.

BACKGROUND OF THE INVENTION

Hydrocarbons, such as oil and gas, may be recovered from various types of subsurface geological formations. The oil and gas is accessed through a well which is typically drilled from the surface to the producing formation. In many wells, hydraulic fracturing is used to promote the production of oil and gas from the formation. A process known as plug and perforation is used to isolate and independently stimulate specific zones within the well.

When the well has been drilled to the desired depth, a steel casing is typically installed and cemented within the wellbore to prevent the sides of the wellbore from collapsing and to control the flow of fluids from the formation into the wellbore. Once the casing is cemented in place, a section of the wellbore can be perforated to provide a path from the formation to the wellbore through the cement and casing. In most cases, explosive charges or high pressure fluids are used to perforate the casing and cement. Once the casing has been perforated, the adjacent and nearby formation can be stimulated through hydraulic fracturing by injecting high pressure fluid and proppant is injected into the formation to open and suspend small cracks in the formation. This generally improves the permeability of the producing formation near the well to increase the flow of hydrocarbons into the well.

In wells that are drilled through multiple production zones, it may be desirable to sequentially stimulate the zones by conducting multiple hydraulic fracturing operations. Plugs or other zone isolation devices are used to control which zones are stimulated by blocking the flow of pressurized fracturing fluid to lower portions of the wellbore. Multiple plugs can be deployed and retrieved to carry out a strategic sequence of hydraulic fracturing.

Several types of plugs have been used in the past. In some cases, the plug is a simple blocking device that must be removed or destroyed with a drill to permit flow of wellbore fluids through the plug. In other cases, the plug is provided with a controllable valve mechanism that can be closed to prevent flow through the plug during a stimulation exercise and opened to permit flow during the production phase of the hydrocarbon recovery effort. A "ball drop plug" utilizes a ball which is dropped into the wellbore and caught by the plug to switch the plug from an open state to a closed state in which flow from the surface is prohibited from passing through the plug. Although widely adopted, conventional ball drop plugs tend to be slow to install and operate and it can be difficult to confirm that the dropped ball has placed the appropriate plug in a closed position.

In contrast to a ball drop plug, a ball-in-place plug is set into the wellbore with a ball already on the seat of the plug while it is run in hole. This speeds up the frac process because the operator does not have to pump a ball down from the surface to close the seat of a ball drop plug. Although ball-in-place plugs are generally effective at isolating lower zones from pressurized fluid above the plug during a hydraulic fracturing operation, the ball-in-place plugs do not permit flow through the plug from the surface for pump down or other operations. If, for example, there are issues with the perforation process, the inability to flow fluid from the surface through the ball-in-place plug can cause costly delays. In these instances it can be necessary to drill out and replace the entire ball-in-place plug.

There is, therefore, a need for an improved plug which saves production time by allowing fluid to flow through the plug and which does not require a ball drop step to set the plug. It is to these and other objectives that the present invention is directed.

SUMMARY OF THE INVENTION

In exemplary embodiments, the plug and perforation system disclosed herein includes a setting tool that is connected to a plug, a perforation gun, and a wireline. The wireline lowers the perforation gun, setting tool and plug into a wellbore. The setting tool then sets the plug into the wellbore at the desired location. The plug includes an anchoring subassembly, a sealing element device, and a flow control subassembly. The anchoring subassembly sets the plug into the wellbore and the sealing element device seals the plug within the wellbore. The flow control subassembly of the plug controls the flow of fluid through the plug and the wellbore. Before the flow control assembly is activated, fluid can flow freely through the plug. Once the flow control assembly has been activated, the plug prevents fluid from flowing through the plug deeper into the wellbore, thereby isolating a wellbore section from other sections of the wellbore. An activated plug can still allow fluid to flow up from the wellbore through the plug. A flow control subassembly can have a threshold which when reached will activate the plug. The plug threshold can be adjusted to respond to different wellbore conditions such as flow rate or plug pressure to activate the plug.

In one embodiment, the present disclosure is directed to a plug configured to isolate formation zones within a wellbore. The plug includes a flow control subassembly configured to control the flow of fluid through the plug and an anchoring subassembly configured to secure the plug in the wellbore. The flow control subassembly includes a central chamber, a ball, and an offset chamber connected to the central chamber. The offset chamber includes a ball release mechanism that is configured to selectively release the ball from the offset chamber into the central chamber.

In another embodiment, the present disclosure is directed to a plug configured to isolate formation zones within a wellbore. The plug includes a flow control subassembly configured to control the flow of fluid through the plug, an anchoring subassembly configured to secure the plug in the wellbore, and a sealing device between the flow control subassembly and the anchoring subassembly. The flow control subassembly includes a central chamber, a ball, and an offset chamber connected to the central chamber. The offset chamber includes a ball release mechanism that is configured to selectively release the ball from the offset chamber into the central chamber.

In yet another embodiment, the present disclosure is directed at a ball-in-place plug configured to isolate formation zones within a wellbore, where the ball-in-place plug includes an anchoring subassembly configured to secure the ball-in-place plug in the wellbore and a flow control subassembly configured to control the flow of fluid through the plug. The flow control subassembly is configured to allow bidirectional flow of fluid through the ball-in-place plug before the ball-in-place plug is activated, and wherein the flow control subassembly is configured to permit only unidirectional flow of fluid through the ball-in-place plug after the ball-in-place plug is activated.

DETAILED DESCRIPTION

Figure 1:
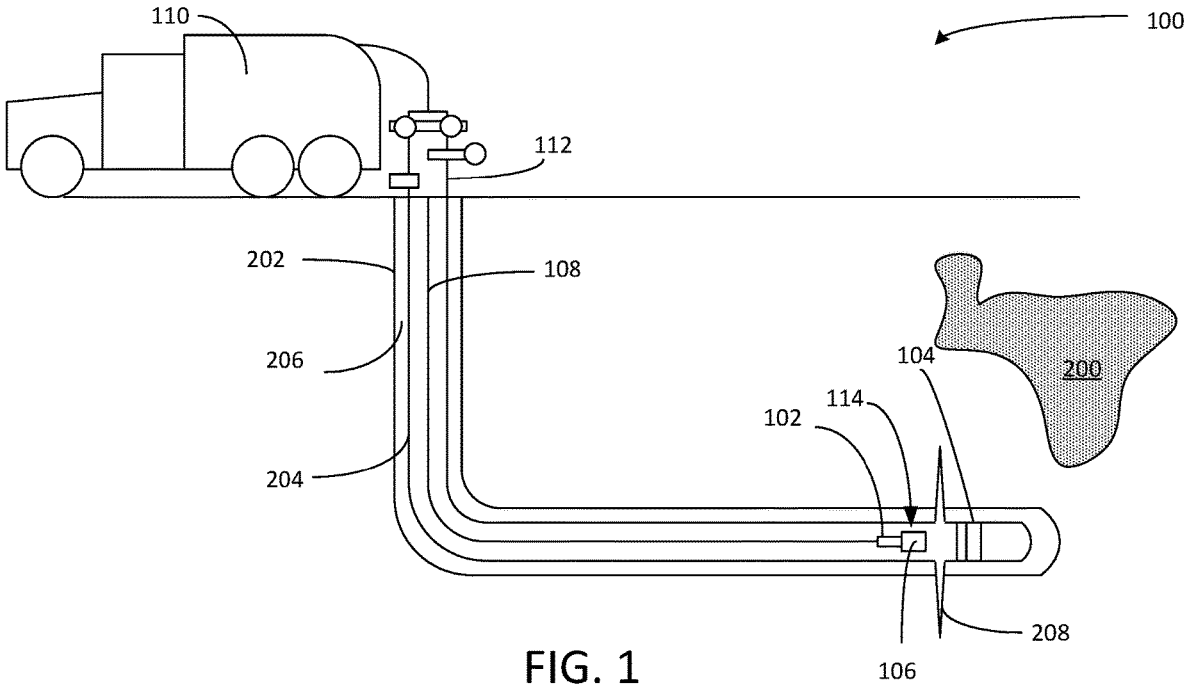
FIG. 1 depicts formation with a horizontal wellbore and one perforated zone.

In accordance with exemplary embodiments of the present invention, FIG. 1 depicts a plug and perforation system 100 installed within a wellbore 202, which is drilled for the production of a fluid such as water or petroleum from a geological formation 200. As used herein, the term "petroleum" refers broadly to all mineral hydrocarbons, such as crude oil, natural gas and combinations of oil and gas. The wellbore 202 is lined with a casing 204 which is set with cement 206. The casing 204 and cement 206 prevent the wellbore 202 from collapsing. After the casing 204 and cement 206 are set into the wellbore 202, the plug and perforation system 100 can be used to prepare the wellbore 202 for hydraulic fracturing.

The plug and perforation system 100 prepares the formation 200 for hydraulic fracturing by perforating the casing 204 and cement 206 using a perforation gun 102 and isolating sections of the wellbore 202 using plugs 104. Using the plug and perforation system 100, sections of the wellbore 202 can be separately perforated. Each perforated section can then be isolated from other sections using one or more plugs 104 so that each perforated section can then be independently hydraulically fractured.

The plug and perforation system 100 includes a setting tool 106 that is connected to the plug 104, a perforation gun 102, and a wireline 108. The plug 104, perforation gun 102 and setting tool 106 can be referred to as the downhole plug assembly 114. The downhole plug assembly 114 is deployed and retrieved using wireline 108. The wireline 108 runs from a wireline van 110 or other wireline deployment machine into the wellbore 202 through a wellhead 112. In some applications, it may be desirable to pump fluid through the wellhead 112 into the wellbore 102 to facilitate the deployment of the downhole plug assembly 114 into the wellbore 102.

As seen in FIG. 1 the perforation gun 102, plug 104, and setting tool 106 have been lowered into a horizontal portion of the wellbore 202 and the perforation gun 102 has been used to create perforations 208 in the formation 200 through the casing 204 and cement 206. The perforation gun 102, and setting tool 106 can now be retrieved and the perforations 208 can be hydraulically fractured ("fracked") to create fissures 210 in the formation 200. In the embodiment depicted in FIG. 1, the plug 104 remains in the casing 204 on the downhole side of the perforated section of the casing 204.

Figure 2:
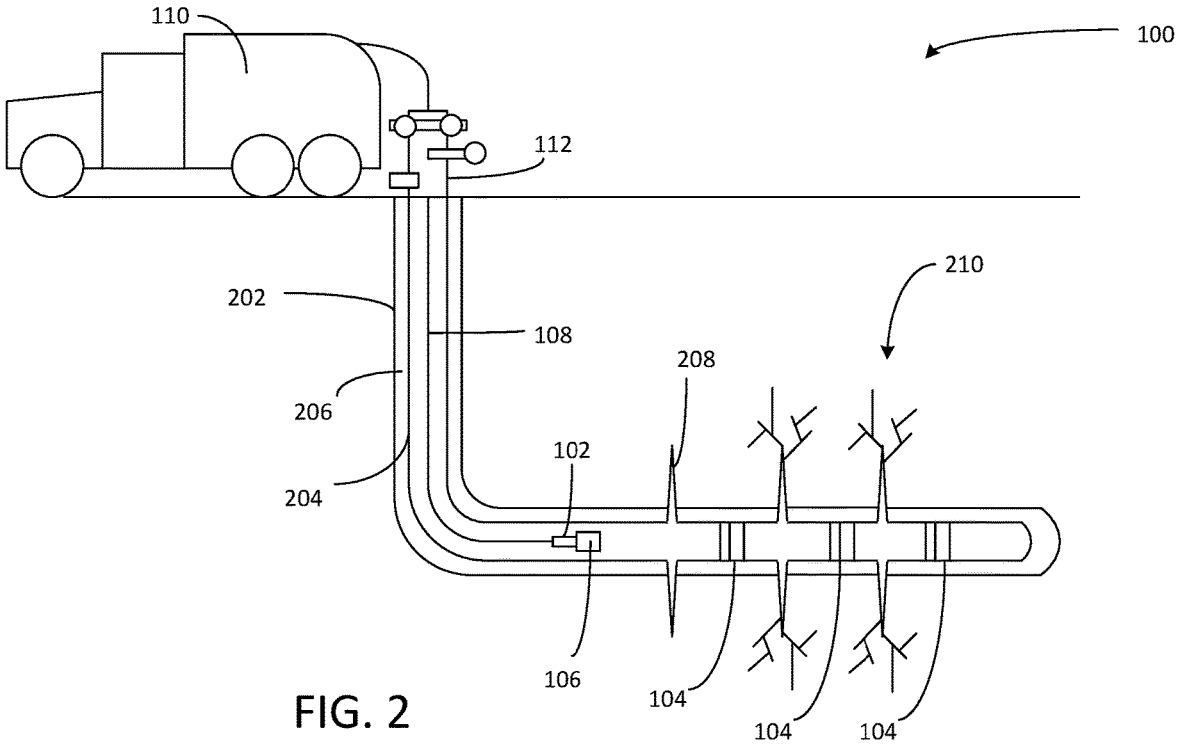
FIG. 2 depicts a formation with a horizontal wellbore with one perforated zone, two fractured zones, and three set plugs.

As depicted in FIG. 2, after the perforated section of the formation 200 has been fracked, the perforation gun 102, plug 104, and setting tool 106 are again lowered into the wellbore 202 using the wireline 108, but this time at a new depth uphole from the fractured section of the wellbore 202. The next plug 104 is then set into the casing 204 using the setting tool 106 in a position uphole from the earlier perforations 208. The perforation gun 102 can then be used again to perforate a new section of formation 200 uphole from the plug 104, to prepare the proximate section of the wellbore 202 for stimulation. This process of perforating, plugging, and fracking can be repeated until the formation 200 is sufficient fracked and ready for production. Three zones are illustrated in FIG. 2, with the third zone ready for the hydraulic fracturing operation.

Figure 3:
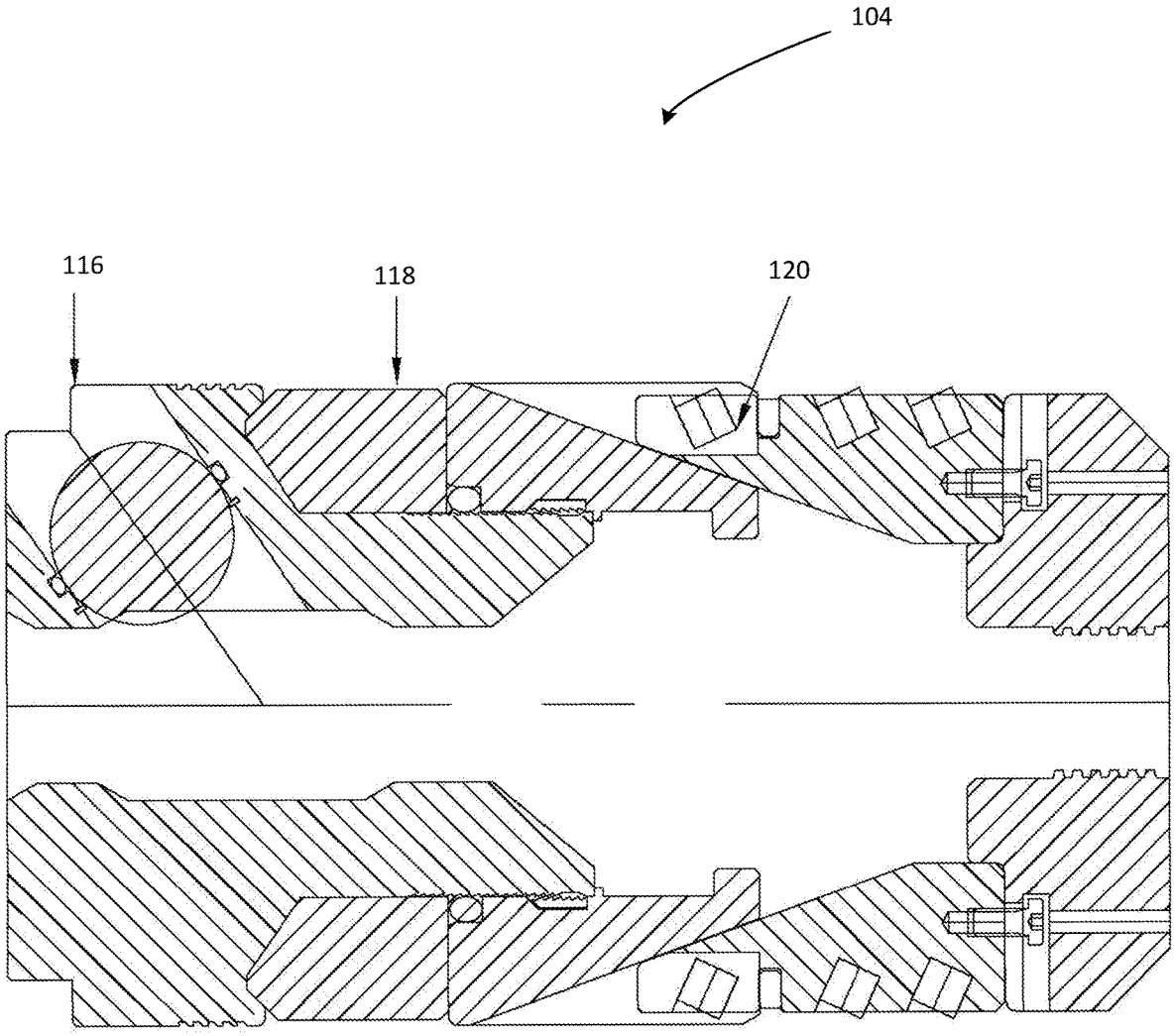
FIG. 3 depicts a cross-sectional view of a dissolvable plug constructed in accordance with an embodiment of the present invention.
Figure 4:
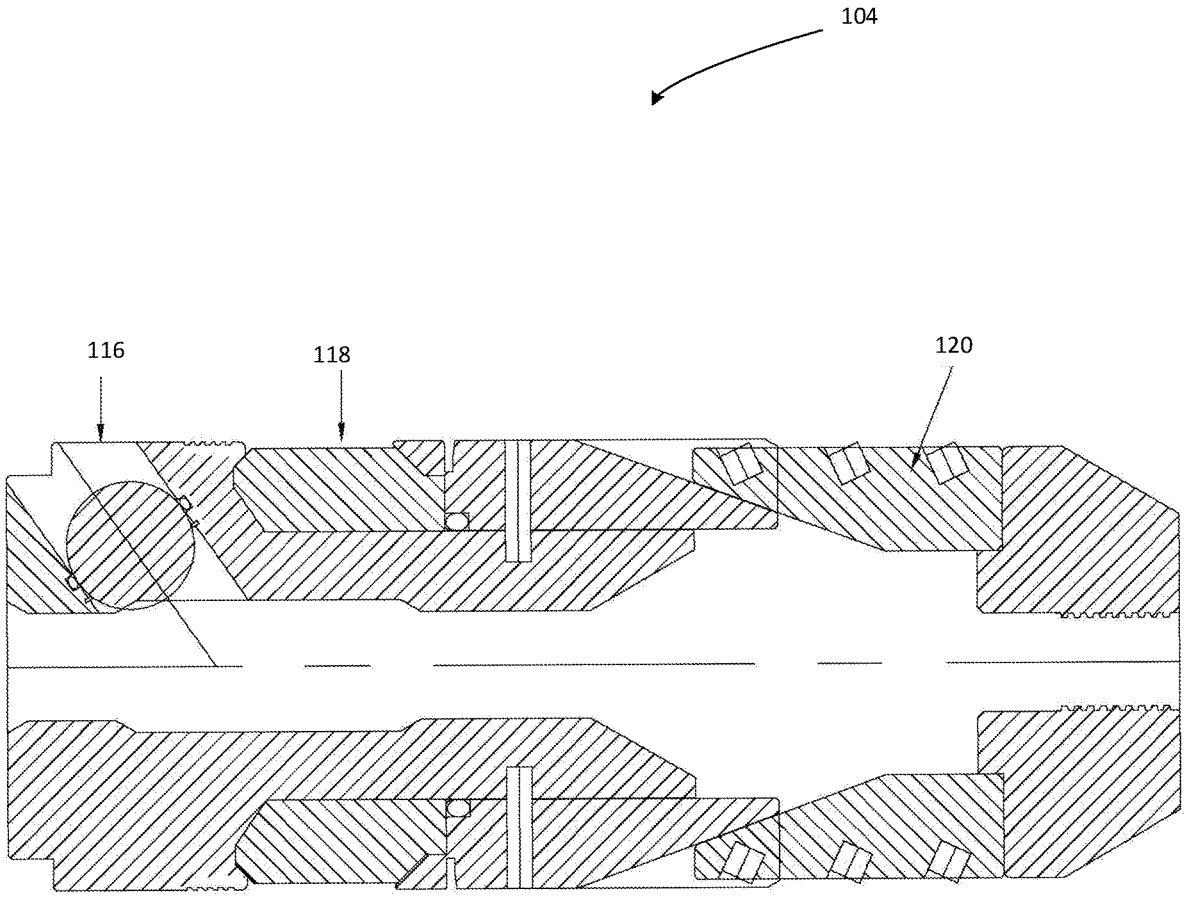
FIG. 4 depicts a cross-sectional view of an embodiment of a composite plug constructed in accordance with an embodiment of the present invention.

Turning now to FIGS. 3 and 4, plugs 104 constructed in accordance with exemplary embodiments of the present invention are shown. The plug 104 includes a flow control subassembly 116, a sealing device 118 and an anchoring subassembly 120. The plug 104 may be constructed of a dissolvable material which will dissolve from the wellbore 202 over time in the presence of wellbore or other fluids, or of a composite material which is impervious to wellbore fluids. Dissolvable materials may include magnesium, aluminum dissolvable alloys, and other dissolvable materials which are able to withstand the well conditions and specific job performance requirements.

The anchoring subassembly 120 sets the plug 104 into the casing 204 of the wellbore 202, preventing movement of the plug 104 within the casing. In the present embodiment, the anchoring subassembly 120 is positioned adjacent to the sealing device 118 at the distal end of the plug 104 from the wireline 108 connection. The sealing device 118 seals the plug 104 between the anchoring subassembly 120 and the casing 204, preventing fluid from flowing between the plug 104 and the casing 204. In the present embodiment the sealing device 118 is positioned between the anchoring subassembly 120 and flow control subassembly 116. The flow control subassembly 116 controls the flow of fluid through the plug 104. In the present embodiment the flow control subassembly 116 is positioned adjacent to the sealing device 118 at the proximal end of the plug 104 from the wireline 108 connection.

Figure 5:
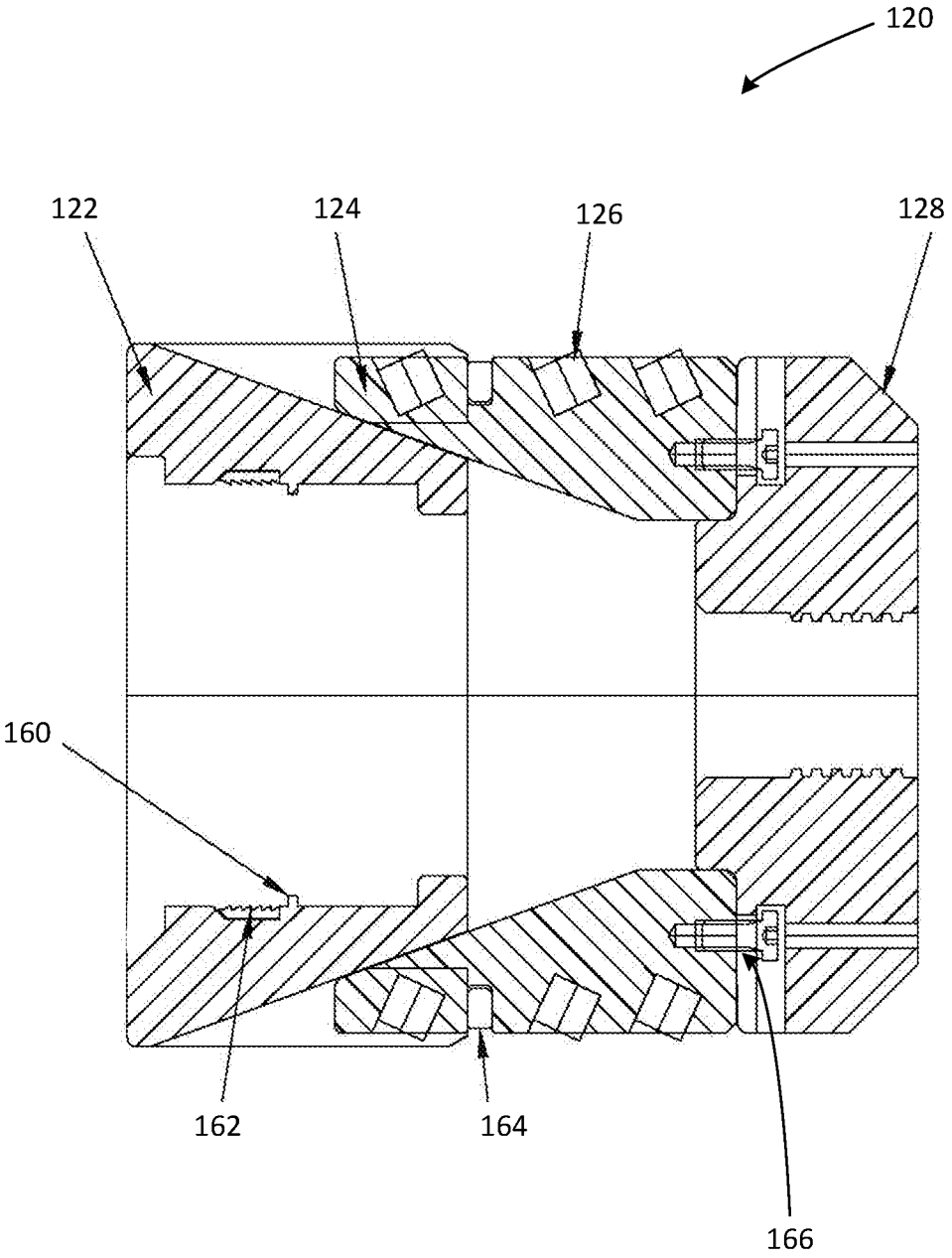
FIG. 5 depicts a cross-sectional view of the anchoring subassembly of the plug of FIG. 3.
Figure 6:
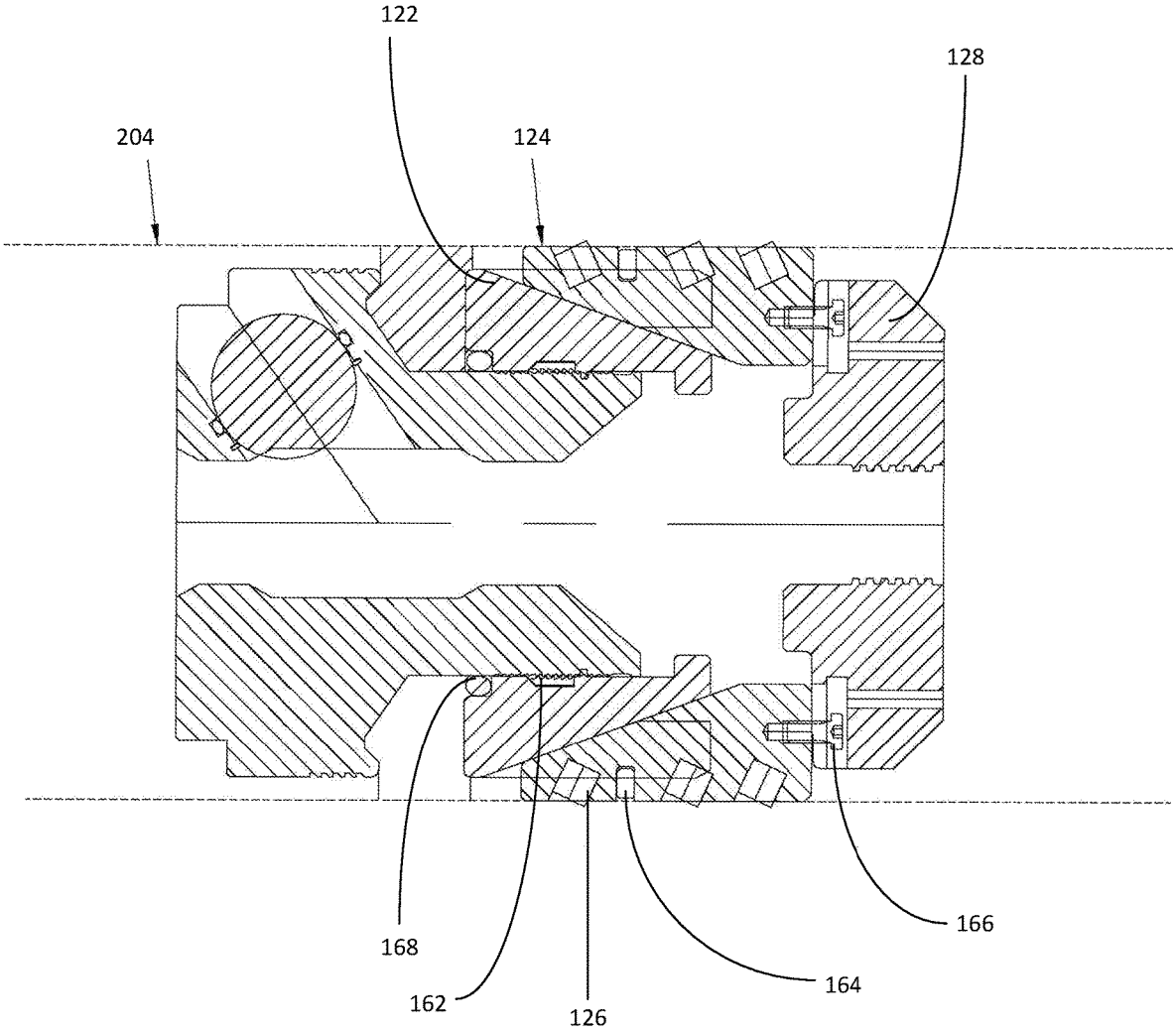
FIG. 6 depicts a cross-sectional view of a plug with the seal element set and the anchoring subassembly slips expanded into the casing.

FIGS. 5 and 6 provide a cross-sectional view of the anchoring subassembly 120 which secures the plug 104 within the casing 204 of the wellbore 202 to allow the plug 104 to withstand axial loads generated by hydraulic fracturing. In the present embodiment, the anchoring subassembly 120 includes a cone 122, a slip 124, one or more slip insets 126 incorporated into the slip 124, and a setting sub 128. In addition to the components of the anchoring subassembly 120 configured for setting the plug 104, the anchoring subassembly 120 has an internal passage that allows fluid to flow from the flow control subassembly 116 and through the plug 104. The anchoring subassembly 120 may also include additional components to facilitate the setting of the anchoring subassembly 120 into the casing 204. These components may include a shear shoulder 160, a ratchet lock ring 162, a slip retaining ring 164, shear pins 166, and an o-ring 168. When the plug 104 is set, the setting tool 106 forces the slip 124 and cone 122 together, which causes the slip 124 to expand outward into the casing 204, as depicted in FIG. 6.

Figure 7:
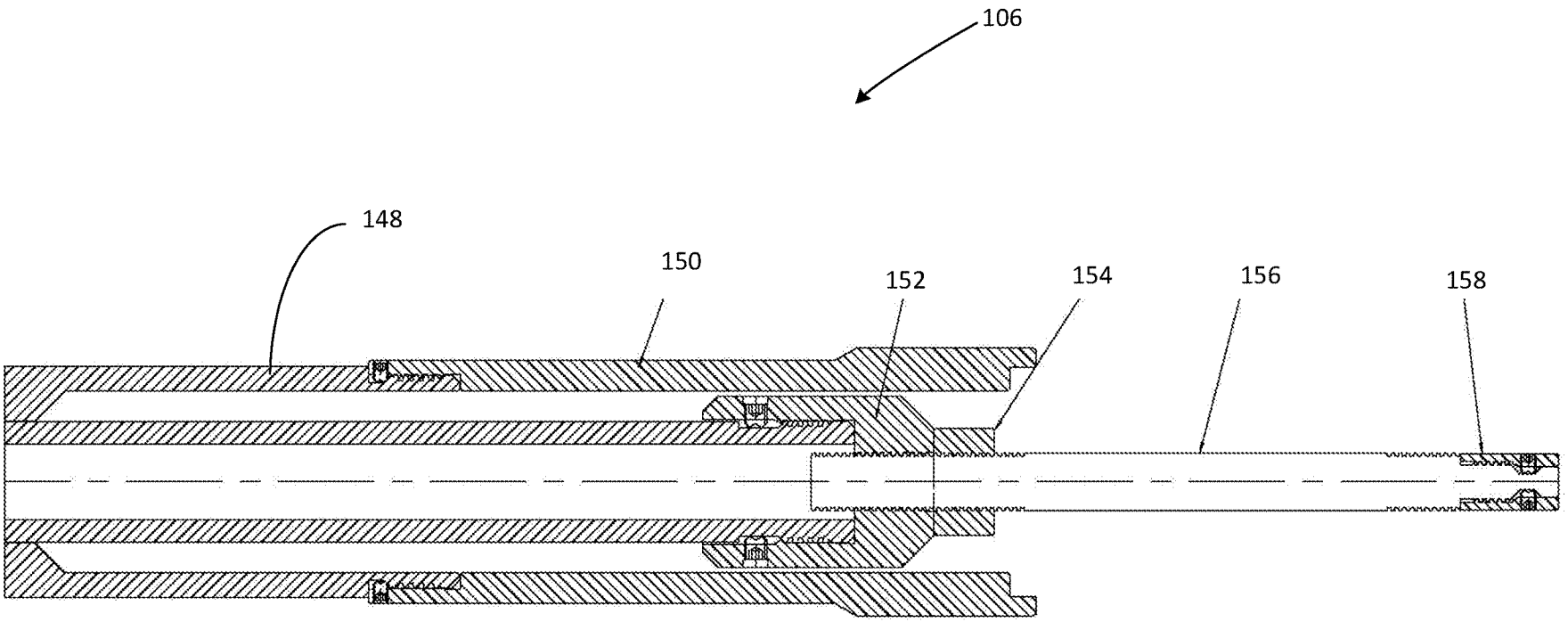
FIG. 7 depicts a cross-sectional view of a setting tool.

Turing now to FIG. 7, shown therein is an embodiment of the setting tool 106 which can be connected to the plug 104 described above. The setting tool 106 is generally configured to set the plug 104 by applying compressive forces across the plug 104 to force the slip 124 over the cone 122. In addition to forcing the anchoring subassembly 120 into the casing, the setting tool 106 also causes the sealing device 118 to expand into the casing 204 seal the plug 104 to the casing 204.

The setting tool 106 includes a setting body 148, a setting sleeve 150 connected to the setting body 148, and an adapter 152 housed within the setting sleeve 150. A tension rod 156 is threaded into the adapter 152 and extends outward from the setting tool 106. The tension rod 156 is connected to the adapter 152 with a rod nut 154 which is tightened to the adapter 152. A locking sub 158 is connected to the distal end of the tension rod 156.

Figure 8:
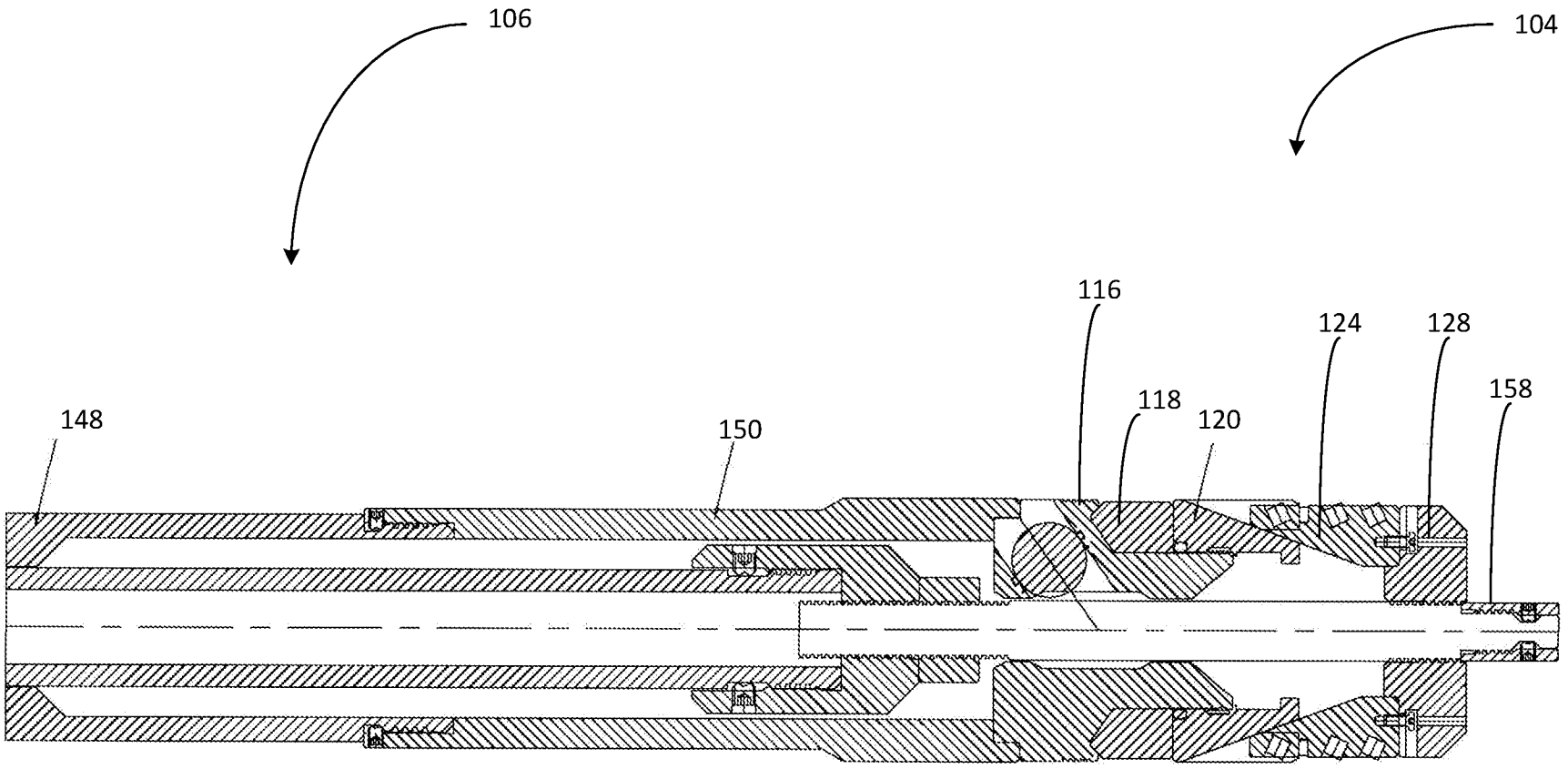
FIG. 8 depicts a cross-sectional view of the plug of FIG. 3 connected to the setting tool of FIG. 7.

In FIG. 8, the setting tool 106 is shown attached to the plug 104. The locking sub 158 is connected to the setting sub 128. During use, the setting body 148 and setting sleeve 150 remain stationary and in contact with the plug 104. The tension rod 156 and locking sub 158 are then retracted under force, which pulls the setting sub 128 into the slip 124, which causes the slip 124 to ride over the outside of the cone 122, thereby expanding the slip 124 into the casing 204 while also expanding the sealing device 118. This sets the plug 104 into position within the casing 204. When the plug 104 is set, the setting tool 106 can be disconnected and retrieved from the wellbore 202.

Figure 9:
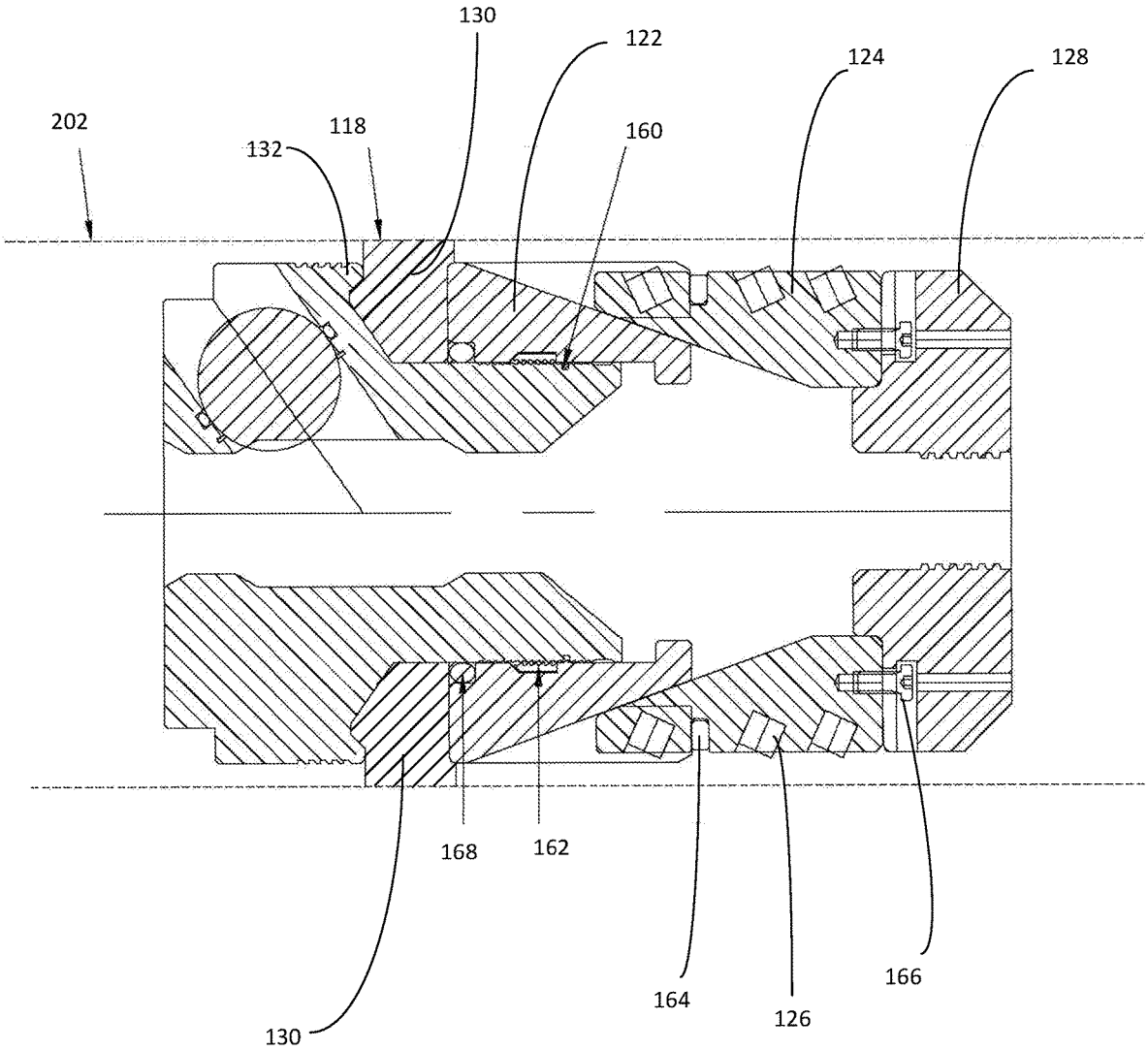
FIG. 9 depicts a cross-sectional view of a plug with the seal element set, but with the slip retracted off the cone.

FIG. 9 depicts the sealing device 118 expanded to engage the casing 204 after the plug 104 has been set by the setting tool 106. In this expanded position, the sealing device 118 prevents fluid from flowing between the plug 104 and the casing 204. The sealing device 118 seals the wellbore 202 by closing gaps between the plug 104 and the casing 204. This seal allows the wellbore 202 to be separated into distinct zones. The distinct zones can then be independently fractured.

The sealing device 118 includes a seal element 130 which engages the casing 204 to close the gaps between the casing 204 and the plug 104. The sealing device 118 may also include back-ups 132 which support the seal element 130 to prevent extrusion of the seal element 130. In some embodiments the seal element 130 will engage the casing 204 through an electrical signal sent through the wireline 108 or through force applied to the plug 104. In some embodiments the seal element 130 is made of rubber or dissolvable rubber materials. Note that in FIG. 9, the slip 124 has not been deployed into the casing 204 by activating the setting tool 106.

Figure 10:
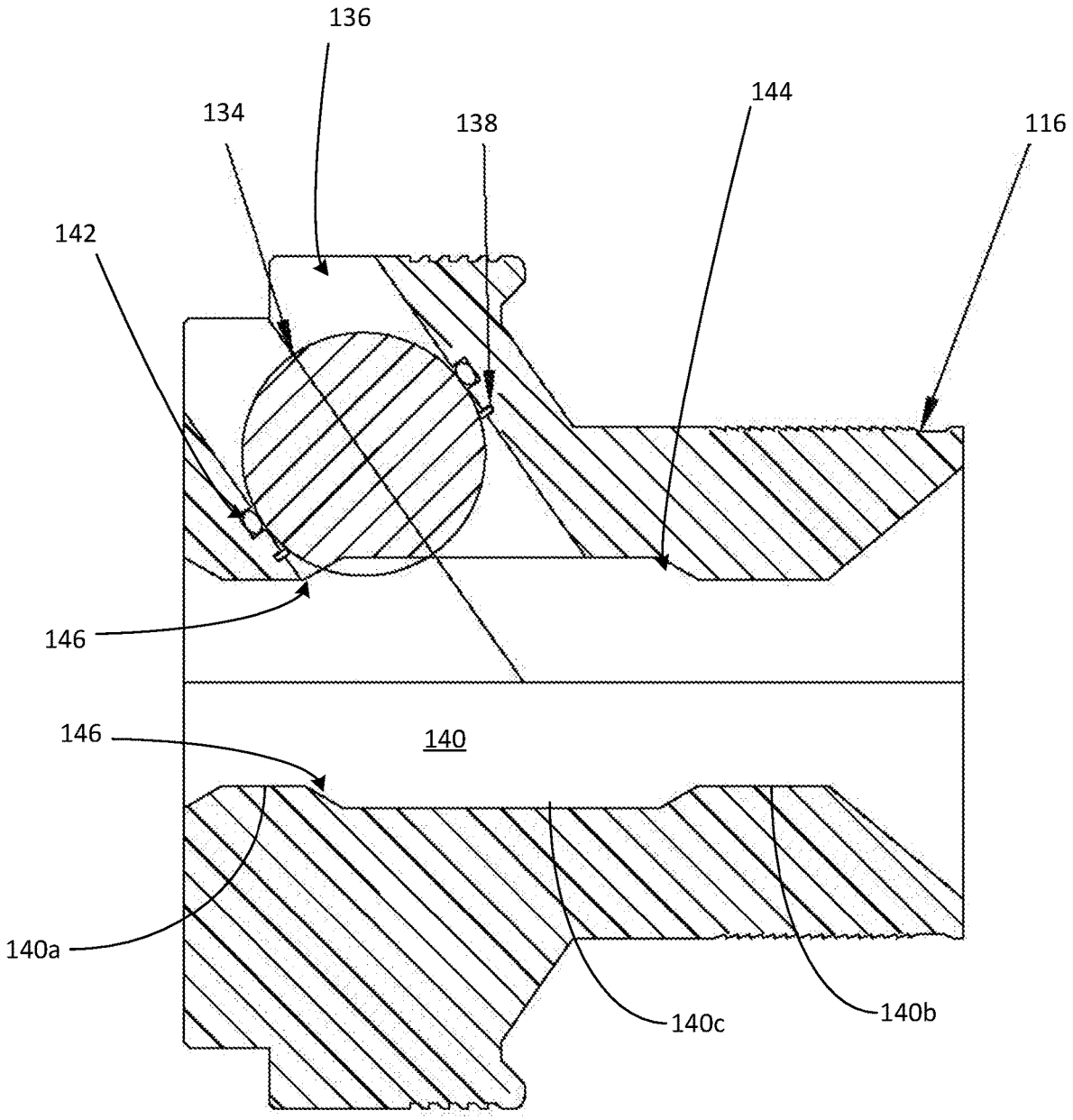
FIG. 10 depicts a cross-sectional view of the flow control subassembly of the plug of FIG. 3.

Turning now to FIG. 10, shown therein is a cross-sectional view of the flow control subassembly 116 which controls the flow of fluid through the plug 104. The flow control subassembly 116 includes a ball 134, an offset chamber 136, a ball release mechanism 138, and a central chamber 140. The central chamber 140 runs along a central longitudinal axis through the flow control subassembly 116, and places the flow control subassembly 116 and the internal passage of the anchoring subassembly 120 in fluid communication. The offset chamber 136 is connected to the central chamber 140 at an angle that is less than orthogonal (e.g., 90 degrees) and greater than co-linear (e.g., 0 degrees) with the central axis that extends through the central chamber 140. The central chamber includes a proximal throat 140*a*, a distal throat 140*b* and a ball chamber 140*c* between the proximal throat 140*a* and the distal throat 140*b*. A downflow ball seat 144 is located between the ball chamber 140*c* and the distal throat 140*b*. An upflow ball seat 146 is located between the proximal throat 140*a* and the ball chamber 140*c*.

The offset chamber 136 is configured to retain the ball 134 until the plug 104 is purposefully activated to permit the plug 104 to prevent the flow of fluid through the plug 104 in a downhole direction. The inner diameter of offset chamber 136 is sized to accommodate the ball 134 in close tolerance. The ball release mechanism 138 is used to retain the ball 134 in the offset chamber 136 until the plug 104 is activated.

Figure 12:
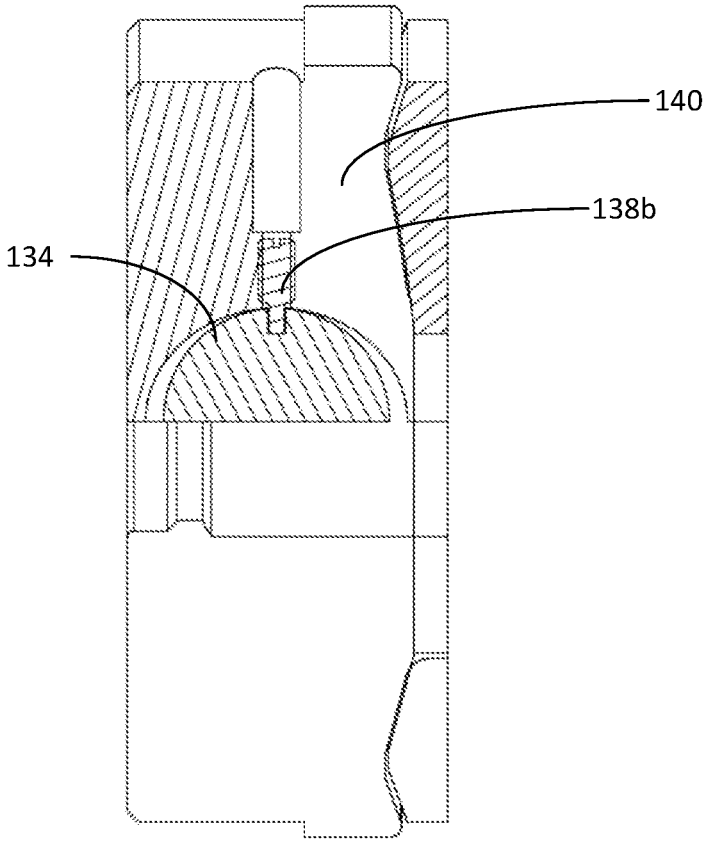
FIG. 12 provides a partial cross-sectional view of a portion of an alternate embodiment the flow control subassembly.

In some embodiments, the ball release mechanism 138 is a shearing ring 138*a* that has a smaller inner diameter that prevents the ball 134 from entering the central chamber 140. If the force applied by the ball 134 to the shearing ring 138*a* exceeds the threshold rupture force of the shearing ring 138*a*, the shearing ring 138*a* will rupture and allow the ball 134 to fall into the central chamber 140. In other embodiments, the ball release mechanism includes one or more shear screws 138*b* that are configured to fracture when exposed to a design load. The use of shear screws 138*b* is depicted in the partial cross-sectional view provided by FIG. 12 in which the offset chamber 136 is oriented in a substantially orthogonal relationship with the central chamber 140.

In other embodiments, the ball release mechanism 138 includes a smaller diameter throat or flange between the offset chamber 136 and the central chamber 140. In this embodiment, the ball 134 can be manufactured from a compliant, deformable material such that the ball 134 can be squeezed through the throat or flange in the offset chamber 136 under sufficient force to allow the ball 134 to enter the central chamber 140.

To improve the reliability of the ball release mechanism 138, the offset chamber 136 may also include a seal 142. In the present embodiment, the seal 142 is incorporated into the walls of the offset chamber 136 to engage the outer surface of the ball 134 while it is held in the offset chamber 136. In this manner, the seal 142 creates a seal between the sides of the offset chamber 136 on either side of the ball 134 to maintain a pressure gradient across the ball 134.

Figure 13:
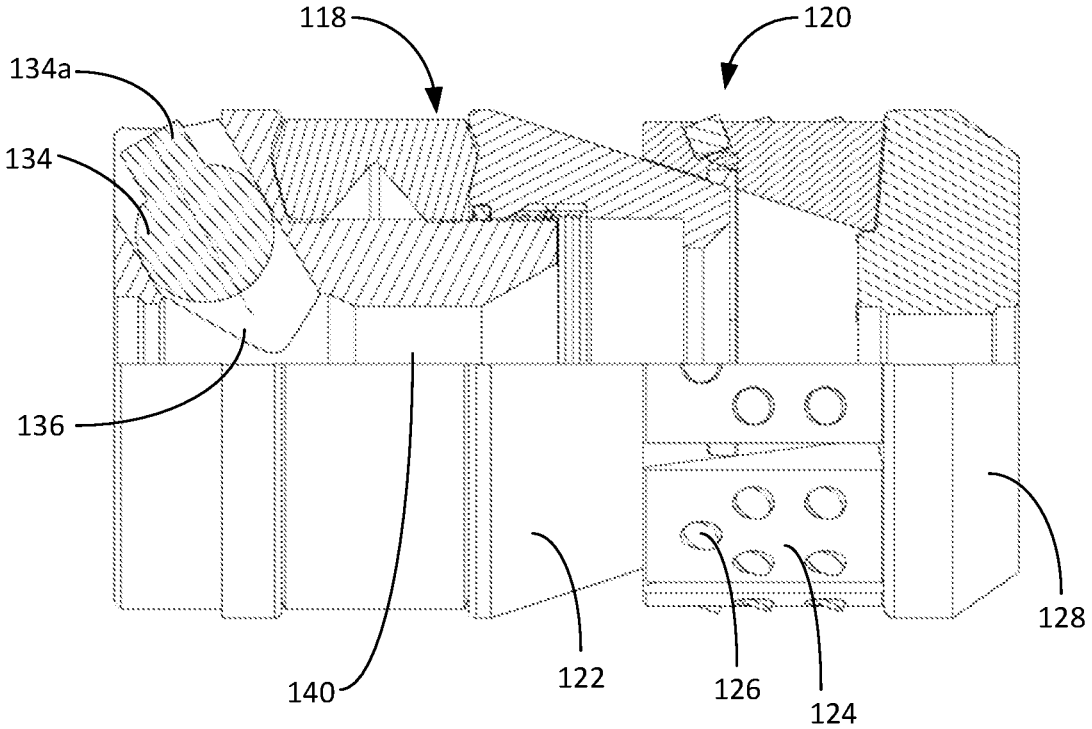
FIG. 13 provides a partial cross-sectional view of an alternate embodiment of the flow control subassembly.

In some embodiments, the ball 134 is provided by an integral extrusion 134 that prevents the ball 134 from spinning within the offset chamber 136. As depicted in FIG. 13, the extrusion 134*a* can be cylindrical in shape and extend from a single side of the ball 134. The extrusion 134*a* does not adversely affect the sealing properties of the ball 134 as it seats on the downflow and upflow seats 144, 146.

The force required to release the ball 134 from the offset chamber 136 can be generated from a positive force applied by fluid acting on the exterior side of the ball 134, a negative (suction) force applied to the interior side of the ball 134 by fluid passing through the central chamber 140, or a combination of positive and negative forces acting on the ball 134. In the embodiment depicted in FIG. 10, the proximal throat 140*a*, ball chamber 140*c* and distal throat 140*b* are configured to induce a Venturi effect as fluid passes through the central chamber 140. In particular, the acceleration of the fluid passing through the proximal throat 140*a* causes a localized pressure drop that can be sufficiently strong to pull the ball 134 out of the offset chamber 136. In some embodiments, the offset chamber 136, ball 134 and ball release mechanism 138 are calibrated such that the ball 134 is forced out of the offset chamber 136 when the flow of pressurized fluids from the surface exceed a threshold (design) flowrate.

In each embodiment, the ball 134 is released from the offset chamber 136 into the ball chamber 140*c*, where the ball can move between the upflow seat 146 and the downflow seat 144. The ball 134 has a greater outer diameter than the inner diameter of the downflow seat 144 or the upflow seat 146. If fluid pressure is greater on the uphole side of the plug 104, the ball 134 is pressed against the downflow seat 144 to stop the flow of fluid through the plug 104. If the fluid pressure is greater on the downhole side of the plug 104, e.g., during a production phase, the ball 134 presses against the upflow seat 146 (and fluid flow passes through the offset chamber 136) or the ball 134 returns to the offset chamber 136 (and fluid flow passes out of the plug 104 through the proximal throat 140*a*).

Figure 11:
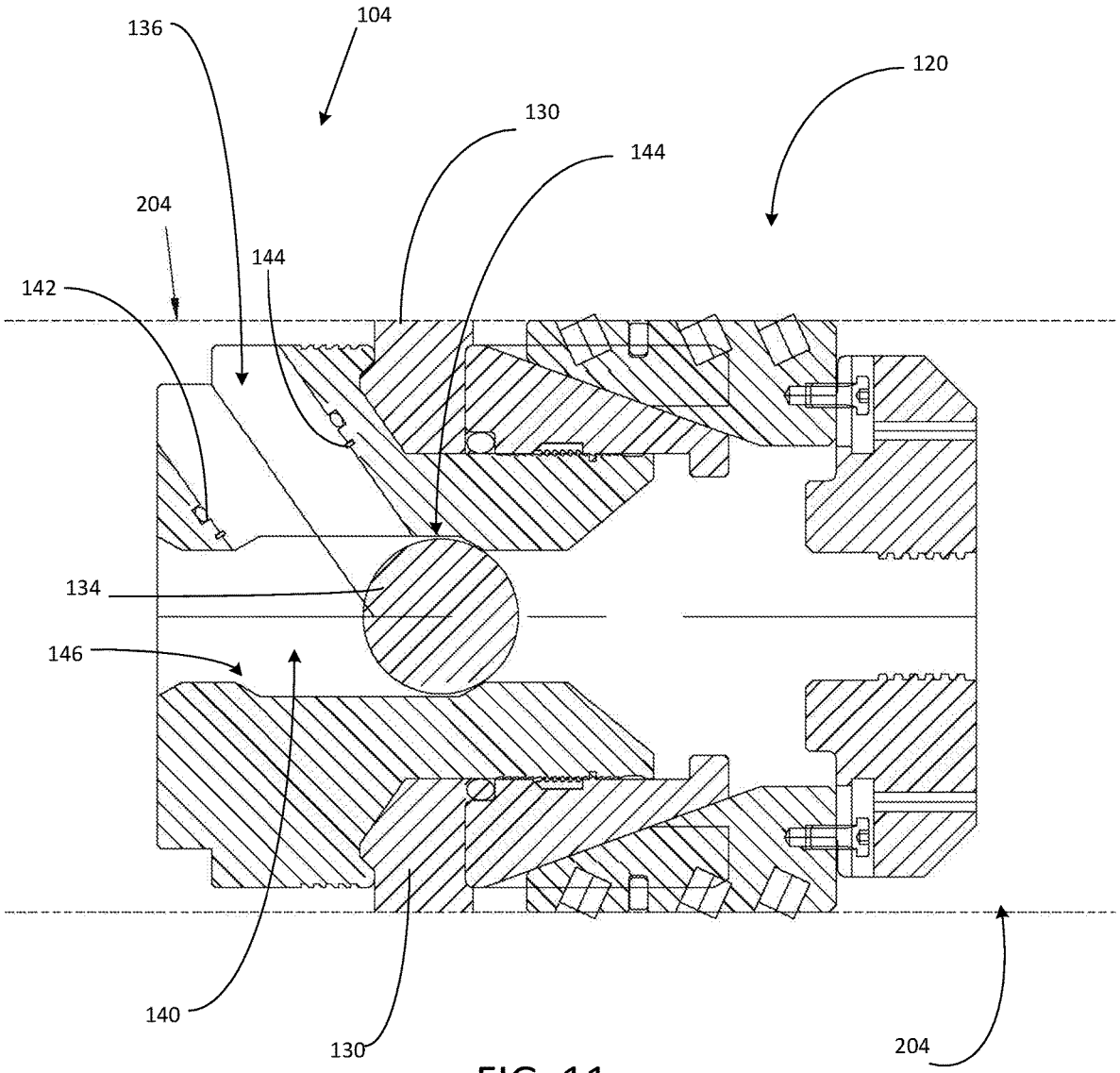
FIG. 11 depicts a cross-sectional view of a plug with the seal element set, the anchoring subassembly slips expanded, and the flow control subassembly activated.

For example, as shown in FIG. 11, when the ball 134 is released from the offset chamber 136, fluid flow through the central chamber 140 forces the ball 134 into the downflow seat 144. When seated against the downflow seat 144, the ball 134 prevents fluid from passing through the plug 104 and deeper into the wellbore 202. Importantly, when the plug 104 has been activated and the ball 134 has been forced into the central chamber 140, the plug 104 can automatically permit the upflow passage of fluids from the wellbore 202 through the plug 104. This is possible because the ball 134 is lifted off the downflow seat 144 by fluid flowing up through the wellbore 202 through the plug 104. When the ball 134 is moved from the downflow seat 144, fluid can flow up through the plug 104 either through the central chamber 140 (if the ball 134 retreats to the offset chamber 136) or through the offset chamber 136 (if the ball 134 lands against the upflow seat 146).

Thus, until the plug 104 is activated, the plug 104 permits the movement of fluids through the central chamber 140 of the plug 104. Once the plug 104 is activated, the plug 104 prevents fluids such as those used in hydraulic fracturing from passing downhole through the plug 104 and deeper into the wellbore 202. Once activated, the plug 104 permits the uphole movement of fluids through the plug 104. In this way, the plug 104 permits bidirectional flow until the plug 104 is activated and the ball 134 is forced out of the offset chamber 136. Once the plug 104 has been activated, the plug 104 acts as a check valve that permits the unidirectional flow of fluids through the plug 104 in the uphole direction while preventing the passage of fluids through the plug 104 in the downhole direction.

Turning back to FIG. 2, it will be appreciated that three plugs 104 have been installed in the wellbore 202. The two plugs 104 set deeper into the horizontal wellbore 202 have been activated and are isolating the fractured sections of the formation 200. The third plug 104 located highest in horizontal wellbore 200 has not been activated. This third plug 104 allows fluid to flow through the plug 104 in either direction. The perforation guns 102 have perforated a new section of the formation 200 and the plug 104 can be activated to isolate the new section for subsequent hydraulic fracturing. If, however, the perforation guns 102 misfired in the new section, the wireline 108 could be easily and quickly retracted and then deployed again with reloaded perforation guns 102. This is possible because the uphole plug 104 has not yet been activated (i.e., the ball 134 is still retained within the offset chamber 136) and fluid can pumped through the plug 104 to assist in movement of the perforation gun 102 into the wellbore 202.

It will be noted that although the plug and perforation system 100 is depicted in a horizontal deployment in FIGS. 1 and 2, the plug and perforation system 100 can also be used other applications, including in vertical and other non-horizontal wellbores 202. Accordingly, any references to "upper" or "higher" and "lower" or "deeper" within this disclosure are merely used to describe the relative positions of components within the plug and perforation system 100 and should not be construed as an indication that the plug and perforation system 100 must be deployed in a single orientation. It will be understood that the term "downhole" is a positional or directional reference to objects or movement in the wellbore 202 that are deeper or further from the surface, while the term "uphole" refers to objects or movements that are closer to the surface. For example, the "uphole" movement of fluid refers to the movement of fluid towards the surface, while the "downhole" movement of fluid refers to the movement of fluid in the wellbore 202 away from the surface.

In this manner, a novel plug 104 and the incorporation of this novel plug 104 into plug and perforation systems 100 produces the various novel methods and apparatuses disclosed herein for controlling the flow of fluid through a plug 104 to provide a more versatile and efficient solution for isolating fracking zones and allowing fluid flow from a wellbore 202. It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A plug configured to isolate formation zones within a wellbore, the plug comprising:

a flow control subassembly configured to control the flow of fluid through the plug, the flow control subassembly comprising:

a central chamber;

a ball; and an offset chamber connected to the central chamber, wherein the offset chamber includes a ball release mechanism that is configured to selectively release the ball from the offset chamber into the central chamber in response to a threshold rupture force that is produced in part by a suction force acting on an interior side of the ball and in part by a positive force acting on an exterior side of the ball within the offset chamber; and an anchoring subassembly configured to secure the plug in the wellbore.

2. The plug of claim 1, wherein the central chamber comprises:

a ball chamber; and a downflow seat, wherein the downflow seat and ball are configured to prevent the flow of fluid in a downhole direction through downflow seat when the ball is seated on the downflow seat.

3. The plug of claim 2, wherein the central chamber further comprises:

a proximal throat;

a distal throat; and an upflow seat, wherein the upflow seat and ball are configured to prevent the flow of fluid in an uphole direction through the upflow seat when the ball is seated on the upflow seat.

4. The plug of claim 3, wherein the ball chamber is between the proximal throat and the distal throat.

5. The plug of claim 1, wherein the offset chamber connects to the central chamber at an angle that is not orthogonal to the central chamber.

6. The plug of claim 1, wherein the ball release mechanism comprises a shearing ring.

7. The plug of claim 1, wherein the ball release mechanism comprises a shear screw.

8. The plug of claim 1, wherein the ball is deformable.

9. The plug of claim 1, further comprising a sealing device between the flow control subassembly and the anchoring subassembly.

10. A plug configured to isolate formation zones within a wellbore, the plug comprising:

a flow control subassembly configured to control the flow of fluid through the plug, the flow control subassembly comprising:

a central chamber;

a ball; and an offset chamber connected to the central chamber and extending to the wellbore, wherein the offset chamber includes a ball release mechanism that is configured to selectively release the ball from the offset chamber into the central chamber in response to a force applied to the ball that exceeds a threshold rupture force of the ball release mechanism, and wherein the threshold rupture force is produced in part by a suction force acting on an interior side of the ball;

an anchoring subassembly configured to secure the plug in the wellbore; and a sealing device between the flow control subassembly and the anchoring subassembly.

11. The plug of claim 10, wherein the anchoring subassembly comprises:

a cone; and a slip configured to expand outward when forced over the cone.

12. The plug of claim 11, wherein the sealing device is deployed when the slip expands outward over the cone.

13. The plug of claim 10, wherein the central chamber comprises:

a proximal throat;

a distal throat; and a ball chamber between the proximal throat and the distal throat, wherein the ball chamber is configured to permit movement of the ball within the ball chamber.

14. The plug of claim 13, wherein the central chamber further comprises a downflow seat, wherein the downflow seat and ball are configured to prevent the flow of fluid in a downhole direction through downflow seat when the ball is seated on the downflow seat.

15. The plug of claim 14, wherein the central chamber further comprises an upflow seat, wherein the upflow seat and ball are configured to prevent the flow of fluid in an uphole direction through the upflow seat when the ball is seated on the upflow seat.

16. The plug of claim 15, wherein the ball release mechanism is selected from the group consisting of a shearing ring and a shear screw.

17. The plug of claim 16, wherein the shearing ring is configured to rupture in response to the suction force acting on an interior side of the ball.

18. A ball-in-place plug configured to isolate formation zones within a wellbore, the ball-in-place plug comprising:

an anchoring subassembly configured to secure the ball-in-place plug in the wellbore; and a flow control subassembly configured to control the flow of fluid through the plug, wherein the flow control subassembly is configured to allow bidirectional flow of fluid through the ball-in-place plug before the ball-in-place plug is activated, and wherein the flow control subassembly is configured to permit only unidirectional flow of fluid through the ball-in-place plug after the ball-in-place plug is activated, where the flow control subassembly comprises:

a central chamber;

a ball;

an offset chamber connected between the central chamber and the wellbore, wherein the offset chamber includes a ball release mechanism configured to selectively release the ball from the offset chamber into the central chamber in response to a combination of positive force applied by fluid acting on the exterior side of the ball and a negative force applied to the interior side of the ball.

* * * * *